US009848692B1

(12) United States Patent
Kato et al.

(10) Patent No.: US 9,848,692 B1
(45) Date of Patent: Dec. 26, 2017

(54) ATTACHING LOOP MEMBER TO MOUNT PRINTING DEVICE ON BELT-LIKE MEMBER WORN BY USER

(71) Applicant: Brother Kogyo Kabushiki Kaisha, Nagoya-shi, Aichi-ken (JP)

(72) Inventors: Yushi Kato, Nagoya (JP); Nobuyuki Iwai, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/441,351

(22) Filed: Feb. 24, 2017

(30) Foreign Application Priority Data

Jun. 27, 2016 (JP) ..... 2016-127082

(51) Int. Cl.

| | |
|---|---|
| ***B41J 3/36*** | (2006.01) |
| ***B41J 29/13*** | (2006.01) |
| ***A45F 5/02*** | (2006.01) |
| ***B41J 29/02*** | (2006.01) |

(52) U.S. Cl.
CPC ..... *A45F 5/021* (2013.01); *B41J 3/36* (2013.01); *B41J 29/02* (2013.01)

(58) Field of Classification Search
CPC . B41J 3/36; B41J 3/445; B41J 2/17553; B41J 29/02
USPC ..... 347/101, 108, 109
See application file for complete search history.

(56) References Cited

U.S. PATENT DOCUMENTS 6,540,122 B1 * 4/2003 Petersen ..... A45F 5/02 224/197
9,475,319 B2 * 10/2016 Corvese ..... B41J 3/36

FOREIGN PATENT DOCUMENTS

JP H11-257319 A 9/1999

* cited by examiner

*Primary Examiner* — An Do
(74) *Attorney, Agent, or Firm* — Banner & Witcoff, Ltd.

(57) ABSTRACT

An attaching loop member to mount a printing device on a belt-like member worn by a user includes: a device-side member connectable to the printing device; and an attaching-side member mountable on the belt-like member worn by the user. The device-side member includes: a device-side plate portion; a fixing portion fixable to the printing device; a shaft portion and an engaging portion provided on the device-side plate portion. The attaching-side member includes: a bearing portion engageable with the shaft portion; an engaged portion engageable with the engaging portion; and an open portion providing an open region between the bearing portion and the engaged portion to allow the belt-like member to penetrate through the open region. The engagement of the shaft portion with the bearing portion allows the device-side member to pivot relative to the attaching-side member to realize engagement and disengagement of the engaging portion relative to the engaged portion.

10 Claims, 12 Drawing Sheets

ATTACHING LOOP MEMBER TO MOUNT PRINTING DEVICE ON BELT-LIKE MEMBER WORN BY USER

CROSS REFERENCE TO RELATED APPLICATION

This application claims priority from Japanese Patent Application No. 2016-127082 filed Jun. 27, 2016. The entire content of the priority application is incorporated herein by reference.

TECHNICAL FIELD

The present invention relates to an attaching loop member that is attached to a belt-like member worn by a user, and a printing device that is secured to the belt-like member by the attaching loop member.

BACKGROUND

A member for attaching a printing device to a belt-like or strip-like shaped member, such as a belt worn by a user, is well known in the art. Japanese Patent Application Publication No. H11-257319 describes a fitting-type connecting mechanism. The fitting-type connecting mechanism functions to mount a portable telephone on a belt clip attached to a belt according to the following procedure. First, a flange part on a distal end of a shaft provided on the belt clip is inserted through a large hole part of the portable telephone. Next, the portable telephone is moved downward to shift the flange part from the large hole part to a small hole part. Subsequently, the portable telephone is rotated a half turn about the shaft. This configuration secures the portable telephone so that the telephone will not become detached from the belt clip. The portable telephone can be removed from the belt clip by performing the above procedure in reverse.

SUMMARY

When using the above structure as a member for attaching a printing device, it is necessary to follow a similar procedure for rotating the printing device when attaching the device to or detaching the device from the belt, requiring a complex procedure when applied to a printing device. Further, the shaft and flange part provided on the conventional belt clip described above protrudes out from the belt clip. This outward protrusion increases the size of the belt clip and increases a potential for other objects to catch on the flange part.

In view of the foregoing, it is an object of the present disclosure to provide an attaching loop member that simplifies a procedure for attaching a printing device to and detaching the printing device from a belt-like member worn by a user while maintaining a small overall size and preventing other objects from getting snagged on the loop member. It is another object of the present disclosure to provide a printing device that is secured to a belt-like member through the attaching loop member.

In order to attain the above and other objects, the disclosure provides an attaching loop member configured to mount a printing device on a belt-like member worn by a user. The attaching loop member includes a device-side member connectable to the printing device, and an attaching-side member mountable on the belt-like member worn by the user. The device-side member includes a device-side plate portion, a fixing portion, a shaft portion, and an engaging portion. The device-side plate portion has a flat plate-like shape and has one end and another end opposite to each other. The fixing portion is provided on the device-side plate portion and is configured to be fixed to the printing device. The shaft portion is provided at the one end of the device-side member. The engaging portion is provided at the another end of the device-side plate portion. The attaching-side member is attachable to and detachable from the attaching-side member. The attaching-side member includes: a bearing portion configured to be engaged with and disengaged from the shaft portion; an engaged portion configured to be engaged with and disengaged from the engaging portion; and a retaining portion configured to retain the belt-like member. Engagement of the shaft portion with the bearing portion allows the device-side member to pivot relative to the attaching-side member in a first pivot direction and in a second pivot direction opposite the first pivot direction, the another end of the device-side plate portion moving toward the attaching-side member in the first pivot direction, the another end of the device-side plate portion moving away from the attaching-side member in the second pivot direction. Pivoting of the device-side member with the shaft portion engaged with the bearing portion in the first pivot direction brings the engaging portion into engagement with the engaged portion, while pivoting of the device-side member with the shaft portion engaged with the bearing portion in the second pivot direction causes the engaging portion to be disengaged from the engaged portion. The retaining portion provides an open region between the bearing portion and the engaged portion. The retaining portion extends in a first direction to provide the open region extending in the first direction. The open region allows the belt-like member to penetrate through the open region in the first direction.

According to another aspect, there is provided a printing device mountable on a belt-like member worn by a user. The printing device includes: a housing configured to accommodate print medium therein; a device-side member connectable to the housing; and an attaching-side member mountable on the belt-like member worn by the user. The device-side member includes a device-side plate portion, a fixing portion, a shaft portion and an engaging portion. The device-side plate portion has a flat plate-like shape and has one end and another end opposite to each other. The fixing portion is provided on the device-side plate portion and is configured to be fixed to the housing. The shaft portion is provided at the one end of the device-side member. The engaging portion is provided at the another end of the device-side plate portion. The attaching-side member is attachable to and detachable from the attaching-side member. The attaching-side member includes: a bearing portion configured to be engaged with and disengaged from the shaft portion; an engaged portion configured to be engaged with and disengaged from the engaging portion; and a retaining portion configured to retain the belt-like member. Engagement of the shaft portion with the bearing portion allows the device-side member to pivot relative to the attaching-side member in a first pivot direction and in a second pivot direction opposite the first pivot direction, the another end of the device-side plate portion moving toward the attaching-side member in the first pivot direction, the another end of the device-side plate portion moving away from the attaching-side member in the second pivot direction. Pivoting of the device-side member with the shaft portion engaged with the bearing portion in the first pivot direction brings the engaging portion into engagement with the engaged portion, while pivoting of the device-side member with the shaft portion engaged with the bearing portion in the second pivot direction causes the engaging portion to be disengaged from the engaged portion. The retaining portion provides an open region between the bearing portion and the engaged portion. The retaining portion extends in a first direction to provide the open region extending in the first direction. The open region allows the belt-like member to penetrate the open region in the first direction.

DETAILED DESCRIPTION

1. Embodiment

Hereinafter, an embodiment of the present disclosure will be described while referring to the accompanying drawings. To facilitate the following description, directions related to a printing device 2 and an attaching loop member 3 according to the embodiment are defined as follows. The upper, lower, upper left, lower right, lower left and upper right sides in FIG. 1 will be respectively defined as upper, lower, front, rear, left, and right sides of the printing device 2 and attaching loop member 3.

<Printing Device 2>

Figure 1:
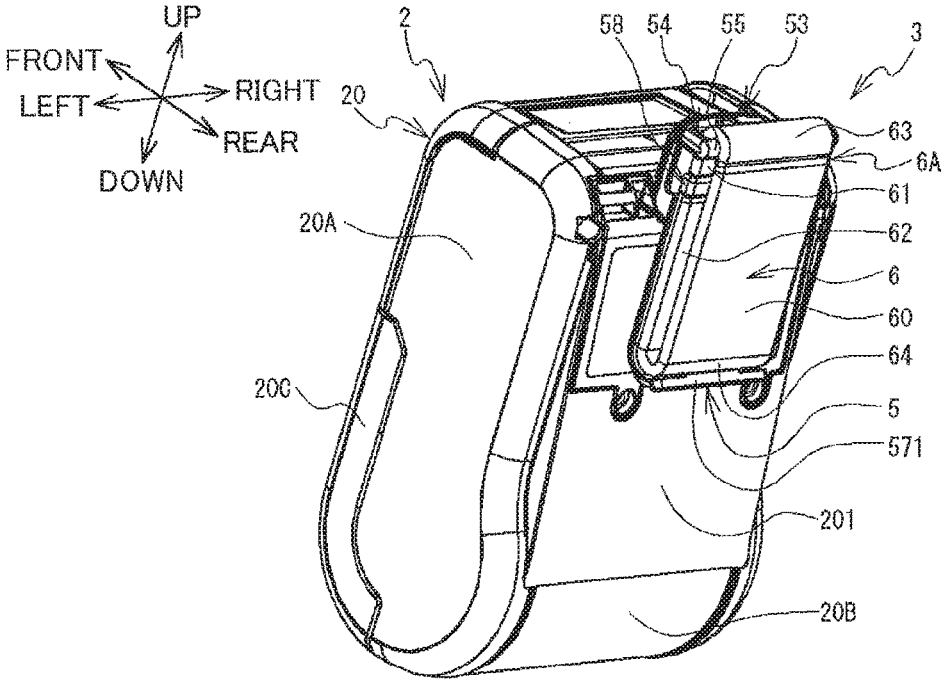
FIG. 1 is a perspective view of a printing device and an attaching loop member according to an embodiment, with the loop member attached to the printing device.
Figure 2:
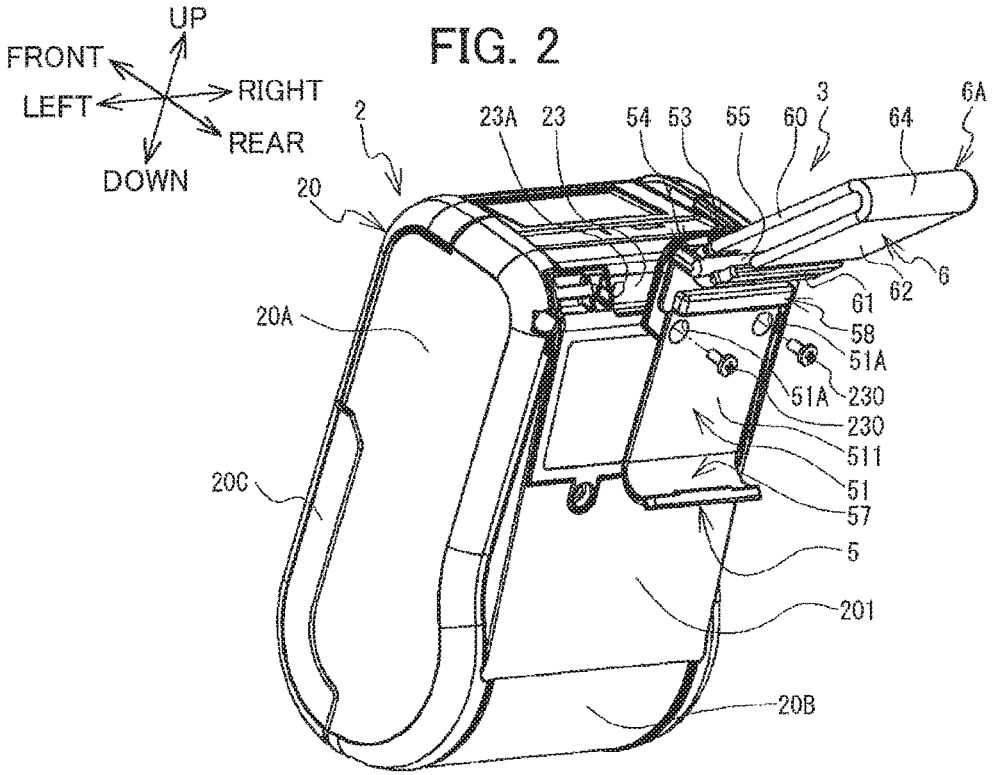
FIG. 2 is a perspective view of the printing device and the attaching loop member according to the embodiment, with the loop member removed from the printing device.
Figure 3:
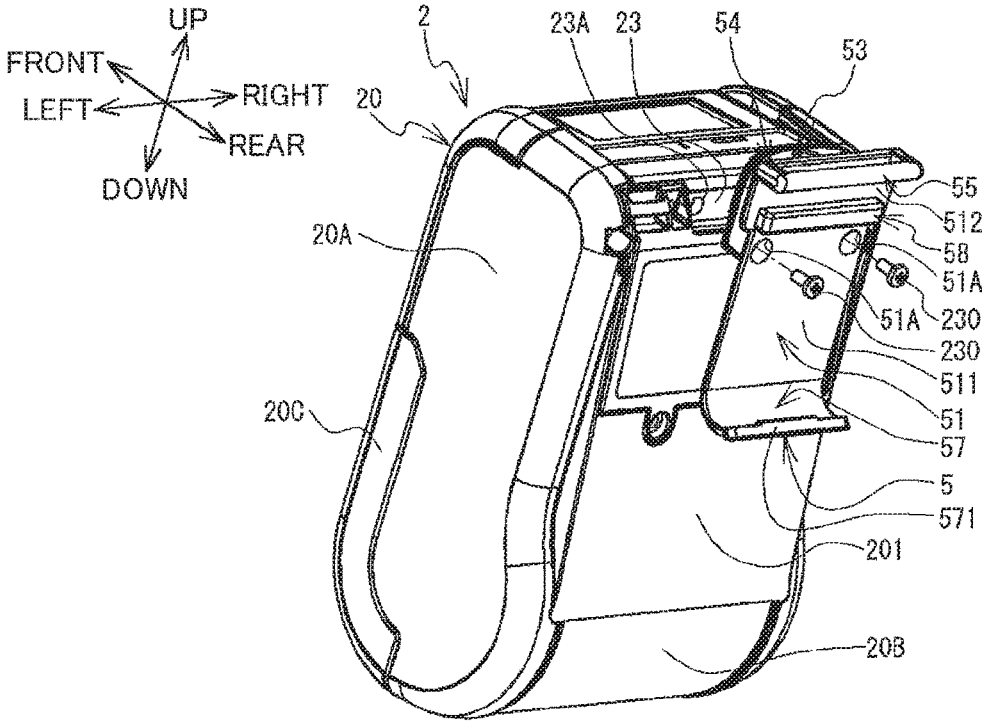
FIG. 3 is a perspective view of the printing device and the attaching loop member according to the embodiment, with a device-side member removed from the printing device.

The printing device 2 is a portable device that is capable of printing letters, graphic characters, symbols, and other characters on thermal paper (printing medium in the embodiment). The printing device 2 is configured to execute printing operations on thermal paper based on data received from a personal computer (not shown) via a USB (registered trademark) cable, for example. As shown in FIGS. 1 through 3, the printing device 2 has a housing 20. The housing 20 includes a first casing 20A, a second casing 20B, a protective plate 201, and a cover 20C. The first casing 20A constitutes a top surface of the housing 20, both left and right side surfaces, and an approximate upper half portion of a front surface of the housing 20. The second casing 20B constitutes a rear surface of the housing 20, and an approximate rearward half portion of a bottom surface of the housing 20. The protective plate 201 is a flat plate member connected to a rear surface of the second casing 20B. The cover 20C constitutes an approximate lower half portion of the front surface of the housing 20, and an approximate forward half portion of the bottom surface.

As shown in FIGS. 2 and 3, a recessed portion 23 is formed in an upper end portion of the second casing 20B. The recessed portion 23 is recessed toward the front. Screw holes 23A are formed in the recessed portion 23. The attaching loop member 3 described later is fixed in the recessed portion 23. Note that the printing device 2 can also be used when the attaching loop member 3 is not fixed in the recessed portion 23, i.e., when the attaching loop member 3 has been removed.

The cover 20C is pivotably supported on a bottom edge of the second casing 20B. The cover 20C opens and closes an accommodating section when pivoted. The accommodating section is provided in an approximate lower half portion of the interior of the housing 20. A roll of thermal paper (not shown) is accommodated in the accommodating section. A discharge opening (not shown) is formed between a bottom edge on the front surface of the first casing 20A and a top edge of the cover 20C when the cover 20C is in its closed position over the accommodating section. The discharge opening is a slit elongated in a left-right direction. While not shown in the drawings, a thermal head, a platen roller, and cutting teeth are provided on the inside of the discharge opening. The discharge opening allows thermal paper to be discharged from the printing device 2 after being printed by the thermal head and platen roller.

<Attaching Loop Member 3>

The attaching loop member 3 is used when the user wishes to operate the printing device 2 described above while the printing device 2 is hanging from a belt-like member worn by the user. Here, the belt-like member worn the user may include a belt worn about the user's waist, a band or a strip-shaped member worn by the user, for example. In the present embodiment, the attaching loop member 3 is used to mount the printing device 2 on a belt 1B worn by the user (see FIGS. 10-12).

As shown in FIGS. 1 and 2, the attaching loop member 3 includes a device-side member 5, and an attaching-side member 6. The device-side member 5 is connectable to the printing device 2. The attaching-side member 6 is mountable on the belt 1B worn by the user. The device-side member 5 and attaching-side member 6 are configured to pivot relative to each other. The device-side member 5 and attaching-side member 6 are formed of a synthetic resin material, for example. The attaching-side member 6 is detachably mountable on the device-side member 5. FIG. 3 shows the device-side member 5 when the attaching-side member 6 has been removed.

<Device-Side Member 5>

Figure 4:
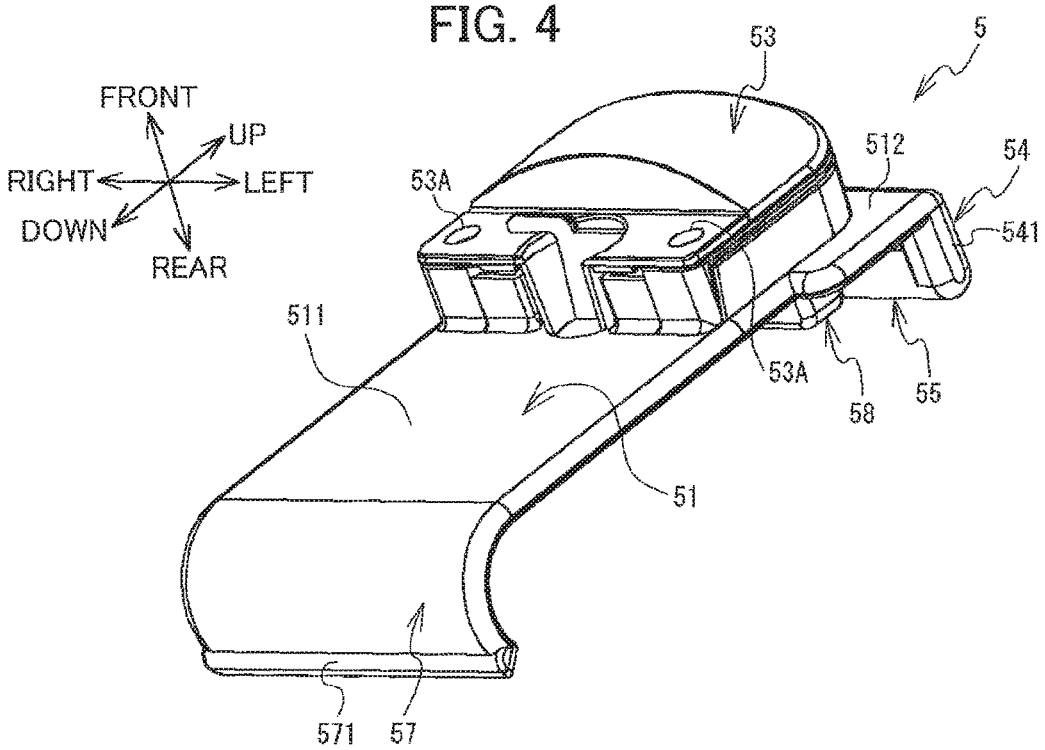
FIG. 4 is a perspective view of the device-side member according to the embodiment as viewed from downward and frontward.
Figure 5:
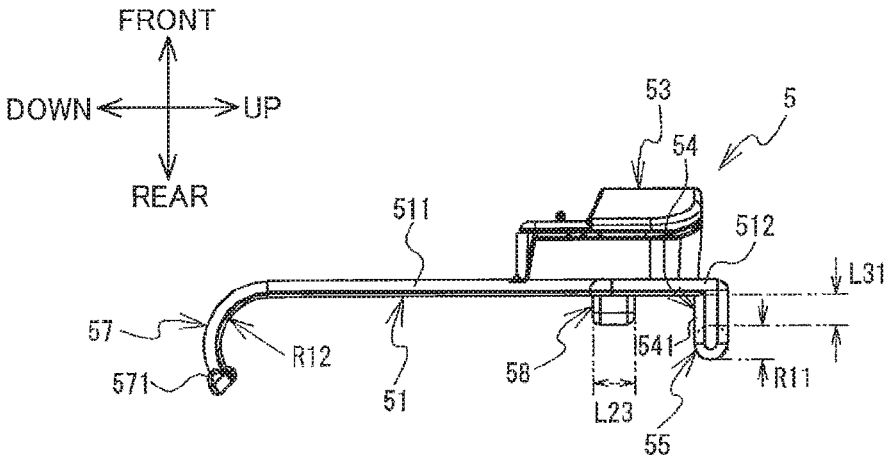
FIG. 5 is a left side view of the device-side member according to the embodiment.
Figure 6:
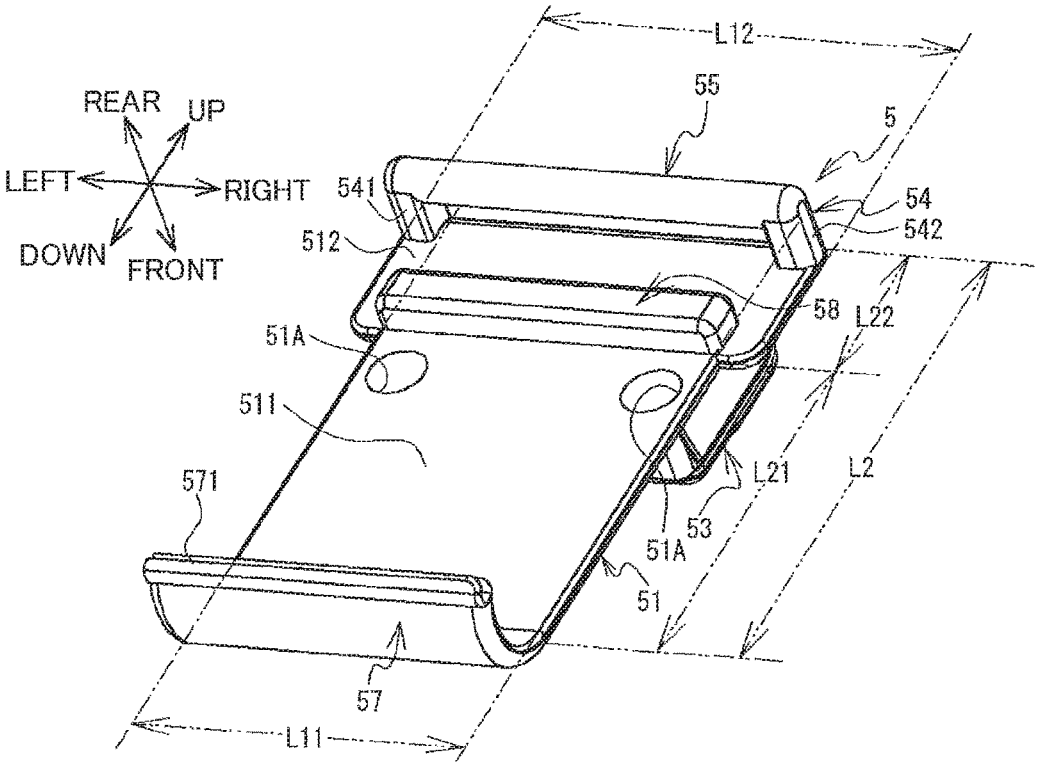
FIG. 6 is a perspective view of the device-side member according to the embodiment as viewed from downward and rearward.

As shown in FIGS. 2 and 3, the device-side member 5 is fixed to the recessed portion 23 of the printing device 2. As shown in FIGS. 4 through 6, the device-side member 5 includes a device-side plate portion 51, a fixing portion 53, shaft support portions 54, a shaft portion 55, an engaging portion 57, and a rib 58.

The device-side plate portion 51 has a flat plate shape. The device-side plate portion 51 includes a first section 511, and a second section 512. The first section 511 of the device-side plate portion 51 has a rectangular shape that is elongated vertically. The second section 512 of the device-side plate portion 51 is connected to a top edge of the first section 511. The second section 512 of the device-side plate portion 51 has a rectangular shape that is elongated in the left-right direction. Left and right edges of the second section 512 of the device-side plate portion 51 protrude farther outward than corresponding left and right edges of the first section 511 of the device-side plate portion 51 with respect to the left-right direction.

As shown in FIG. 6, two holes 51A are formed in an upper end portion of the first section 511 of the device-side plate portion 51 near respective left and right corners. Each hole 51A is a circular through-hole that penetrates the upper end portion of the first section 511 of the device-side plate portion 51 in a front-rear direction. A screw 230 (see FIGS. 2 and 3) is inserted through each hole 51A from a rear side thereof.

Hereinafter, referring to FIG. 6, L11 denotes a left-right dimension of the first section 511 and L21 denotes a vertical dimension of the first section 511 of the device-side plate portion 51. Further, L12 denotes a left-right dimension of the second section 512 and L22 denotes a vertical dimension of the second section 512 of the device-side plate portion 51. The left-right dimension L12 of the second section 512 of the device-side plate portion 51 is greater than the left-right dimension L11 of the first section 511 of the device-side plate portion 51. The vertical dimension L21 of the first section 511 of the device-side plate portion 51 is greater than the vertical dimension L22 of the second section 512 of the device-side plate portion 51. The sum of the vertical dimensions of the first section 511 and second section 512 constituting the device-side member 5 will be called a "vertical dimension L2 of the device-side member 5".

As shown in FIGS. 4 and 5, the fixing portion 53 is provided on an upper portion of the front surface of the first section 511 and the front surface of the second section 512 constituting the device-side plate portion 51. The fixing portion 53 has a box-like shape and protrudes forward from the front surface of the device-side plate portion 51. A bottom end portion constituting the front surface of the fixing portion 53 is shaped to fit in the recessed portion 23 of the printing device 2 (see FIGS. 2 and 3). As shown in FIG. 4, two holes 53A are formed in the bottom end portion on the front surface of the fixing portion 53 near left and right corners thereof. The holes 53A are circular through-holes that penetrate the bottom end portion constituting the front surface of the fixing portion 53 in the front-rear direction. The screws 230 (see FIGS. 2 and 3) passing through the holes 51A formed in the device-side plate portion 51 (see FIG. 6) are inserted through the corresponding holes 53A from the rear side toward the front side thereof.

As shown in FIG. 6, the shaft support portions 54 are configured of a shaft support part 541 and a shaft support part 542. The shaft support part 541 is disposed in an upper-left corner of the second section 512 constituting the device-side plate portion 51, while the shaft support part 542 is disposed in an upper-right corner of the second section 512. The shaft support parts 541 and 542 are collectively referred to as the shaft support portions 54. The shaft support portions 54 have a bar-like shape. The shaft support portions 54 protrude rearward from the rear surface of the second section 512. The shaft support parts 541 and 542 define a distance therebetween that is slightly greater than the left-right dimension L11 of the first section 511. More specifically, the distance between inner left-right sides of the shaft support parts 541 and 542 is slightly greater than the left-right dimension L11 of the first section 511.

The shaft portion 55 has a circular columnar shape. The shaft portion 55 is disposed at and along a top edge portion of the second section 512 of the device-side plate portion 51. The shaft portion 55 is elongated in the left-right direction. The shaft portion 55 has a left end that is supported by the shaft support part 541, and a right end that is supported by the shaft support part 542. The shaft portion 55 extends parallel to the device-side plate portion 51 to connect rear ends of the shaft support parts 541 and 542. The shaft portion 55 has a left-right dimension that is substantially equivalent to the left-right dimension of the second section 512. That is, the left-right dimension of the shaft portion 55 is L12. As shown in FIG. 5, the shaft portion 55 is separated from the device-side plate portion 51 to the rear by a prescribed gap L31. The shaft portion 55 has a diameter R11, as shown in FIG. 5.

As shown in FIG. 4, the engaging portion 57 is disposed on a bottom edge of the first section 511. The engaging portion 57 curves rearward while extending downward from the bottom edge of the first section 511. That is, the engaging portion 57 has an arcuate shape in a side view, as shown in FIG. 5. The engaging portion 57 has flexibility. In the following description, the side of the engaging portion 57 facing a center of curvature of its arcuate shape will be called an "inner side of the engaging portion 57", while the side opposite the center of curvature will be called an "outer side of the engaging portion 57". As shown in FIG. 5, the inner side of the engaging portion 57 has a radius of curvature R12 (hereinafter called a "radius of curvature of the engaging portion 57"). The engaging portion 57 includes a protruding part 571 provided on an edge of the engaging portion 57 opposite the first section 511 (hereinafter called a "distal edge of the engaging portion 57"). The protruding part 571 extends along the distal edge in the left-right direction. The protruding part 571 protrudes outward from an outer surface of the engaging portion 57.

As shown in FIG. 6, the rib 58 is disposed on the rear surface of the second section 512 along a bottom edge thereof. The rib 58 protrudes rearward from the rear surface of the second section 512. The rib 58 is elongated in the left-right direction and has a square column shape. The rib 58 has a left-right dimension that is substantially equivalent to the left-right dimension of the first section 511. That is, the left-right dimension of the rib 58 is L11. As shown in FIG. 5, the rib 58 has a vertical dimension L23.

<Attaching-Side Member 6>

Figure 7:
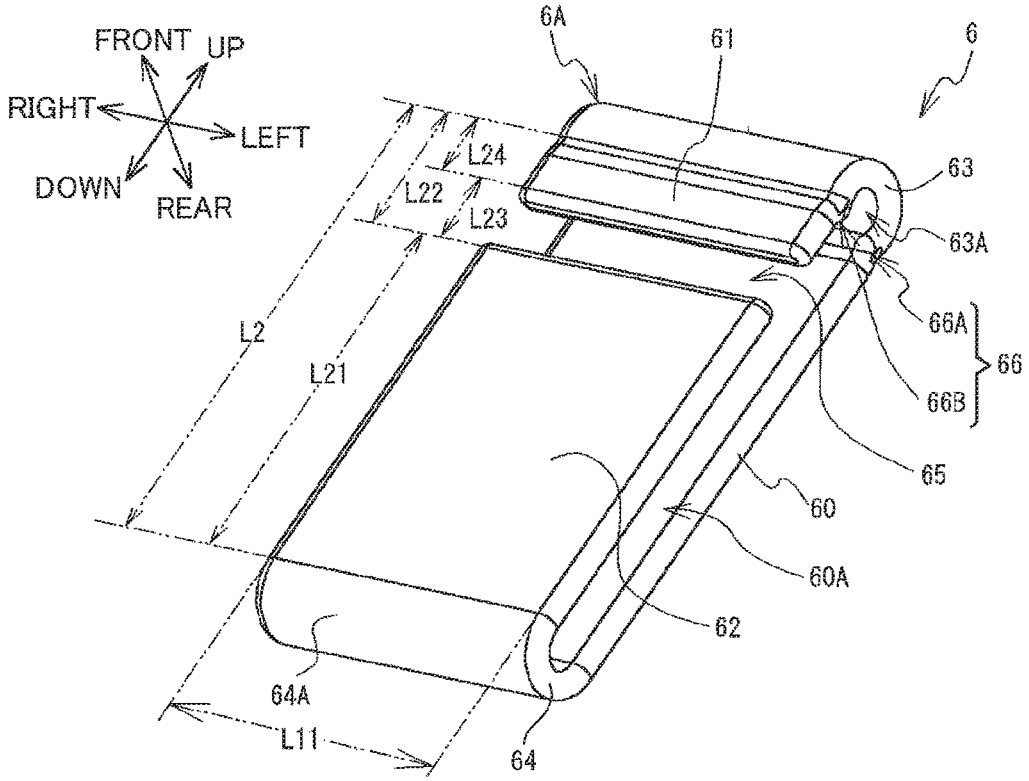
FIG. 7 is a perspective view of an attaching-side member according to the embodiment as viewed from downward and frontward.
Figure 8:
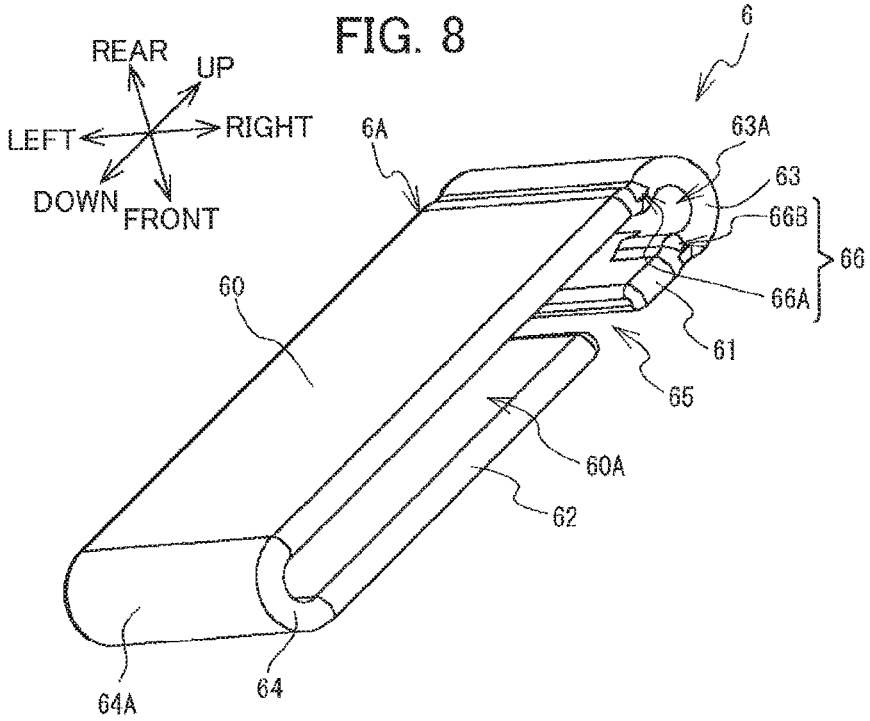
FIG. 8 is a perspective view of the attaching-side member according to the embodiment as viewed from downward and rightward.
Figure 9:
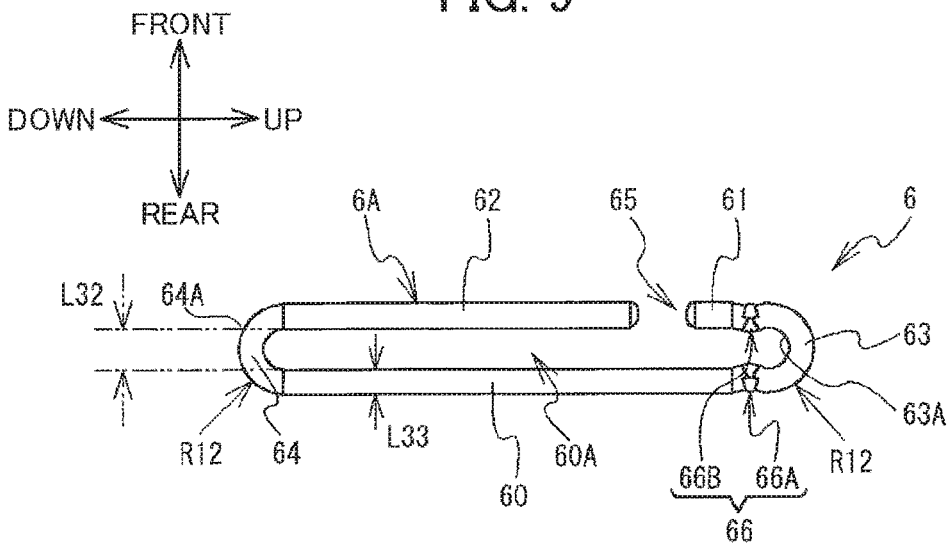
FIG. 9 is a left side view of the attaching-side member according to the embodiment.

The attaching-side member 6 is attachable to and detachable from the device-side member 5 fixed to the printing device 2. Specifically, as shown in FIGS. 1 and 2, the attaching-side member 6 can be pivotably supported on the device-side member 5. As shown in FIGS. 7 through 9, the attaching-side member 6 has an attaching-side plate portion 6A. The attaching-side plate portion 6A has a curved plate shape. The attaching-side plate portion 6A includes a base portion 60, a first segment portion 61, a second segment portion 62, a first curved portion 63, and a second curved portion 64.

Each of the base portion 60, first segment portion 61, and second segment portion 62 has a flat plate shape. The base portion 60, first segment portion 61, and second segment portion 62 extend orthogonal to the front-rear direction, respectively. The base portion 60 and second segment portion 62 have a rectangular shape that is elongated vertically. The first segment portion 61 has a rectangular shape that is elongated in the left-right direction. The first segment portion 61 and second segment portion 62 are arranged frontward of the base portion 60 and spaced apart from the base portion 60 by a prescribed distance. The first curved portion 63 connects respective top edges of the base portion 60 and first segment portion 61. The second curved portion 64 connects respective bottom edges of the base portion 60 and second segment portion 62. The first curved portion 63 and second curved portion 64 are curved in a general U-shape in a side view. The first curved portion 63 expands above the top edges of the base portion 60 and first segment portion 61. The second curved portion 64 expands below the bottom edges of the base portion 60 and second segment portion 62. In the following description, the sides of the first curved portion 63 and second curved portion 64 facing toward centers of curvature of their respective arcuate shapes will be called an "inner side of the first curved portion 63" and an "inner side of the second curved portion 64", respectively, while the sides opposite their centers of curvature will be called an "outer side of the first curved portion 63" and an "outer side of the second curved portion 64", respectively. The first curved portion 63 and second curved portion 64 are both resiliently deformable.

Figure 10:
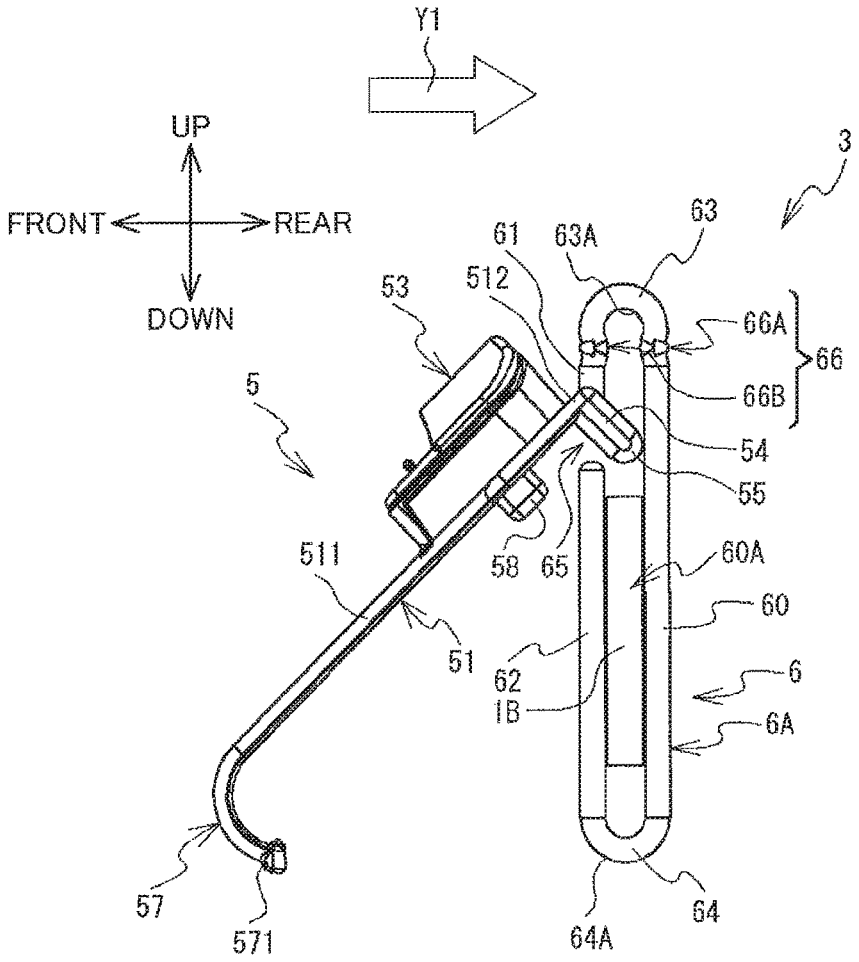
FIG. 10 is a left side view illustrating attachment of the device-side member to the attaching-side member according to the embodiment.
Figure 11:
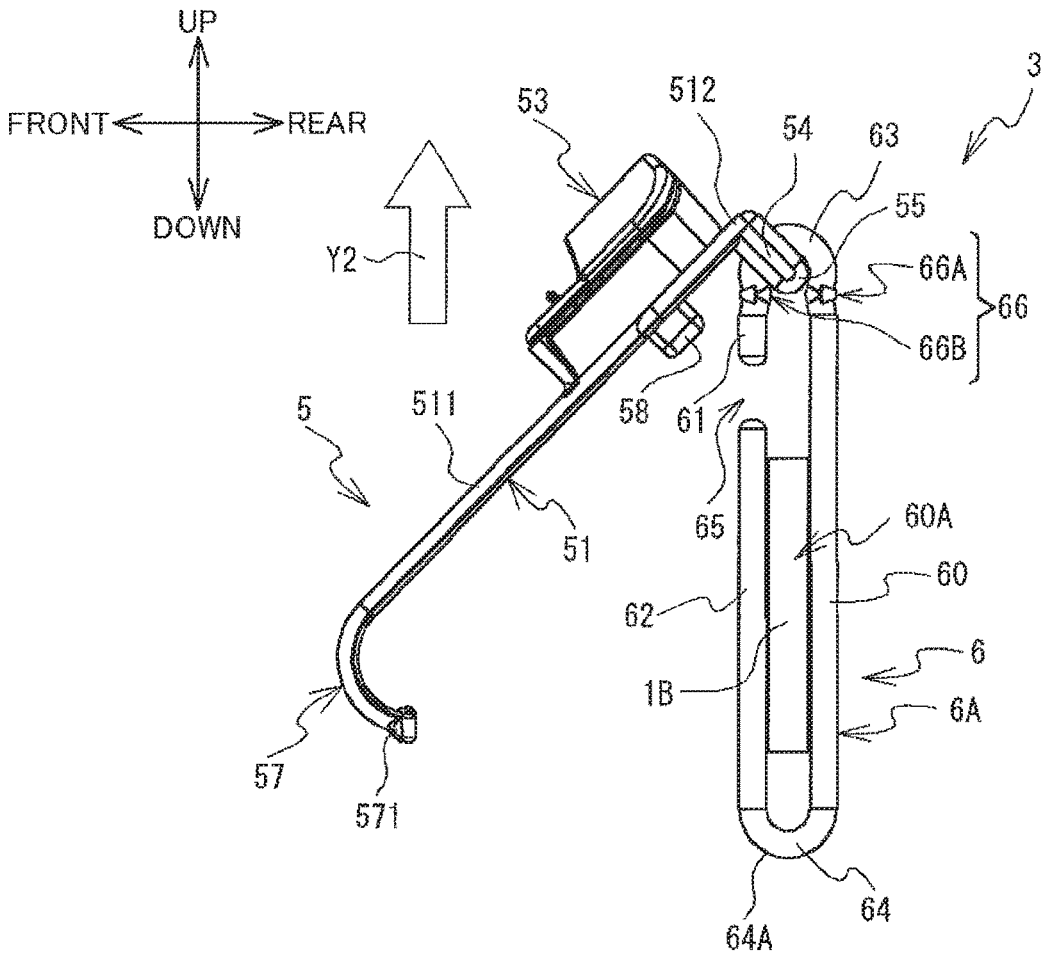
FIG. 11 is a left side view of the attaching loop member according to the embodiment in a first engaged state.
Figure 12:
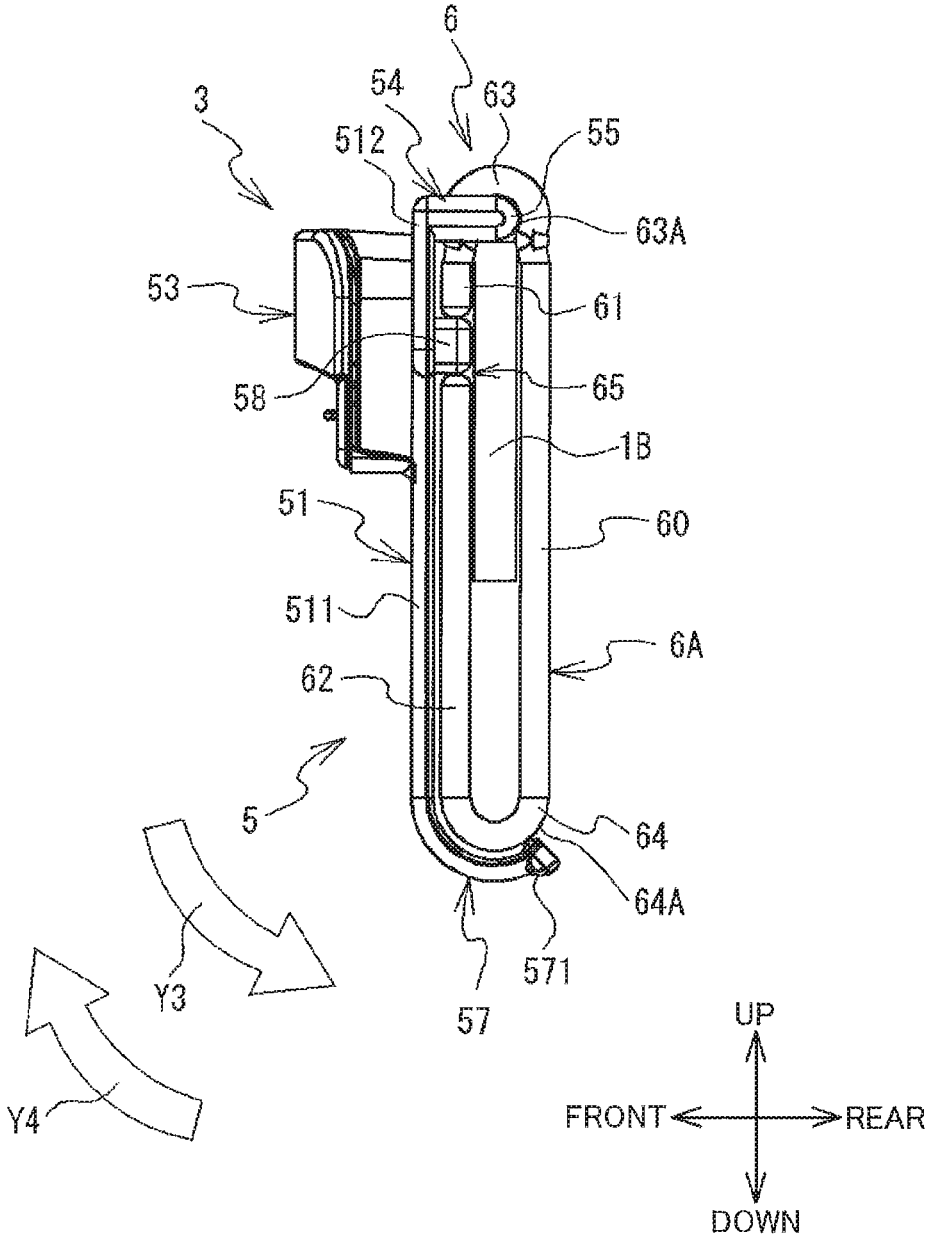
FIG. 12 a left side view of the attaching loop member according to the embodiment in a second engaged state.

The first curved portion 63 has an inner surface facing the inner side of the first curved portion 63. Hereinafter, the inner surface of the first curved portion 63 will be called a "bearing portion 63A", since this inner surface of the first curved portion 63 (bearing portion 63A) provides a space for receiving the shaft portion 55 of the device-side member 5 therein when the device-side member 5 is attached to the attaching-side member 6. Further, an outer surface of the second curved portion 64 will be called an "engaged part 64A". Further, in the attaching-side plate portion 6A, a space covered by the base portion 60, first segment portion 61, and second segment portion 62 will be called an "open region 60A". In other words, the base portion 60, first segment portion 61 and second segment portion 62 constitute a portion for retaining the belt 1B and provide the open region 60A through which the belt 1B penetrates. The open region 60A is a space positioned frontward of the base portion 60 and rearward of the first segment portion 61 and second segment portion 62. That is, the open region 60A is a space penetrating the attaching-side plate portion 6A in the left-right direction. The open region 60A extends between the bearing portion 63A and the engaged part 64A in a vertical direction. The bearing portion 63A and the open region 60A are aligned vertically. The open region 60A is in communication with the space provided by the bearing portion 63A (inner surface of the first curved portion 63). The space provided by the bearing portion 63A and the open region 60A together provide a continuous space through which the belt 1B worn by the user penetrates, as shown in FIGS. 10 to 12.

As shown in FIG. 7, the attaching-side plate portion 6A (the base portion 60, first segment portion 61, and second segment portion 62) has a left-right dimension L11 that is equivalent to the left-right dimension of the first section 511 of the device-side member 5 (see FIG. 6). The base portion 60 has a vertical dimension L2 that is substantially equal to the vertical dimension of the device-side member 5 (see FIG. 6). The second segment portion 62 has a vertical dimension L21 that is substantially equivalent to the vertical dimension of the first section 511 of the device-side member 5 (see FIG. 6). The first segment portion 61 has a vertical dimension L24 that is shorter than the vertical dimension L21 of the second segment portion 62.

As shown in FIG. 9, the open region 60A in the attaching-side plate portion 6A has a width L32. That is, the width L32 is a gap defined between the first segment portion 61 and the base portion 60 and between the second segment portion 62 and the base portion 60. The width L32 is slightly greater than the diameter R11 of the shaft portion 55 of the device-side member 5 (see FIG. 5). The attaching-side plate portion 6A has a thickness that is uniform at the base portion 60, first segment portion 61, and second segment portion 62. Hereinafter, this thickness of the attaching-side plate portion 6A will be called a "thickness L33". The thickness L33 is slightly smaller than the gap L31 between the second section 512 of the device-side plate portion 51 and the shaft portion 55 (see FIG. 5). A radius of curvature for the inner surface of the first curved portion 63 (hereinafter called a "radius of curvature of the bearing portion 63A") and a radius of curvature for an inner surface of the second curved portion 64 are both substantially equivalent to the radius of the shaft portion 55 in the device-side member 5 (see FIG. 5; R11/2). Further, a radius of curvature for the outer surface of the second curved portion 64 (hereinafter called a "radius of curvature of the engaged part 64A") and a radius of curvature for an outer surface of the first curved portion 63 are both substantially equivalent to the radius of curvature R12 of the engaging portion 57 of the device-side member 5 (see FIG. 5).

As shown in FIG. 7, a gap is formed between the bottom edge of the first segment portion 61 and the top edge of the second segment portion 62. This gap will be referred to as a slit 65 formed in the attaching-side plate portion 6A in the embodiment. That is, the slit 65 is elongated in the left-right direction to be open on left and right edges of the attaching-side plate portion 6A. The slit 65 has a left-right dimension that is substantially equivalent to the left-right dimension L11 of the attaching-side plate portion 6A. The slit 65 has a width L23 that is substantially equivalent to the vertical length of the rib 58 of the device-side member 5 (see FIG. 5). Specifically, the width L23 of the slit 65 is a vertical distance between the bottom edge of the first segment portion 61 and the top edge of the second segment portion 62. The width L23 of the slit 65 is slightly greater than the diameter R11 of the shaft portion 55 (see FIG. 5). A sum of the vertical dimension L23 of the slit 65 and the vertical dimension L24 of the first segment portion 61 is substantially equivalent to the vertical dimension L22 of the second section 512 constituting the device-side plate portion 51 of the device-side member 5 (see FIG. 6).

As shown in FIG. 9, a protrusion 66A is provided on the top edge of the base portion 60, and a protrusion 66B is provided on the top edge of the first segment portion 61. The protrusion 66A protrudes forward, and the protrusion 66B protrudes rearward. The protrusion 66A and 66B oppose each other in the front-rear direction. Collectively, the protrusion 66A and 66B will be referred to as "protrusions 66", hereinafter. The protrusions 66 are formed by bending portions of the attaching-side plate portion 6A into the open region 60A. The protrusions 66 are provided in proximity to a bottom of the bearing portion 63A. The width of the open region 60A in the attaching-side plate portion 6A, more specifically, the gap between the base portion 60 and first segment portion 61, is slightly smaller than the width L32 in a region that the protrusions 66 are disposed. More specifically, the gap between the base portion 60 and first segment portion 61 in the region that the protrusions 66 are disposed is slightly smaller than the diameter R11 of the shaft portion 55 constituting the device-side member 5 (see FIG. 5). Hereinafter, the gap (width) of the open region 60A in the region at which the protrusion 66A and 66B are disposed will be referred to as a "gap between the protrusions 66A and 66B."

<How to Use the Attaching Loop Member 3>

Initially, the device-side member 5 and attaching-side member 6 of the attaching loop member 3 are separated from each other. Hereinafter, this state will be called a "separated state" of the attaching loop member 3. The belt 1B (see FIGS. 10 through 12) is inserted through the open region 60A formed in the attaching-side plate portion 6A of the attaching-side member 6 in the left-right direction along which the open region 60A extends. Note that, generally, the belt 1B has a width that is smaller than the vertical dimension L21 of the second segment portion 62 constituting the attaching-side plate portion 6A (see FIG. 7). Hence, after being inserted through the open region 60A, the belt 1B can move vertically within the open region 60A.

In the meantime, as shown in FIG. 3, the device-side member 5 is fixed to the recessed portion 23 of the printing device 2 as follows. The two screws 230 are inserted from the rear side through the two holes 51A of the device-side plate portion 51 and the two holes 53A of the fixing portion 53 (see FIG. 4). The screws 230 are then screwed into the corresponding screw holes 23A of the recessed portion 23. While the device-side member 5 is fixed to the printing device 2, the approximate upper half portion of the device-side member 5 protrudes above the upper end of the printing device 2.

Then, the user places the device-side member 5 frontward of the attaching-side member 6 mounted on the belt 1B, and adjusts the device-side member 5 such that the device-side plate portion 51 is sloped relative to the front-rear direction. Specifically, an angle that the device-side member 5 forms with the attaching-side member 6 is adjusted so that the surface of the device-side plate portion 51 on which the fixing portion 53 is provided (i.e., front surface of the device-side plate portion 51) faces diagonally upward and forward (see FIG. 10). The device-side member 5 is thus positioned so that the shaft portion 55 is disposed in front of the slit 65 of the attaching-side member 6. Further, the belt 1B is arranged in the open region 60A so as to be lower than the slit 65.

As shown in FIG. 10, the device-side member 5 is then moved rearward relative to the attaching-side member 6 (in a direction shown by an arrow Y1). The shaft portion 55 of the device-side member 5 is inserted through the slit 65 of the attaching-side member 6 from the front side thereof, thereby inserting the shaft portion 55 into the open region 60A of the attaching-side member 6. Note that the printing device 2 fixed to the device-side member 5 is not shown in FIGS. 10 through 14. As described earlier, the width L23 of the slit 65 (see FIG. 7) is slightly greater than the diameter R11 of the shaft portion 55 (see FIG. 5). In other words, the slit 65 has a sufficient width to allow passage of the shaft portion 55. Hence, when performing the above process, the slit 65 does not hinder insertion of the shaft portion 55 into the open region 60A. Further, since the belt 1B is disposed lower than the slit 65, the belt 1B does not hinder insertion of the shaft portion 55 into the open region 60A, either.

Next, the user applies force to the device-side member 5 in an upward direction indicated by an arrow Y2 in FIG. 11. Consequently, the shaft portion 55 of the device-side member 5 moves upward within the open region 60A of the attaching-side member 6. As described above, the width L32 of the open region 60A (see FIG. 9) is slightly larger than the diameter R11 of the shaft portion 55 (see FIG. 5). In other words, the gap between the base portion 60 and first segment portion 61 is sufficiently large for allowing passage of the shaft portion 55. Hence, the base portion 60 and first segment portion 61 do not hinder movement of the shaft portion 55 along the open region 60A.

In the process of moving the shaft portion 55 upward along the open region 60A, the first segment portion 61 of the attaching-side member 6 moves downward relative to the shaft portion 55. Here, the gap L31 between the second section 512 of the device-side plate portion 51 and the shaft portion 55 (see FIG. 5) is slightly larger than the thickness L33 of the first segment portion 61 of the attaching-side member 6 (see FIG. 9). Further, the distance between the inner surfaces (right and left surfaces) of the shaft support parts 541 and 542 that support the shaft portion 55 is slightly greater than the left-right dimension L11 of the attaching-side plate portion 6A constituting the attaching-side member 6 (see FIGS. 6 and 7). Hence, as the shaft portion 55 moves upward through the open region 60A, the first segment portion 61 moves relatively downward so as to pass between the second section 512 of the device-side plate portion 51 and the shaft portion 55 and between the shaft support parts 541 and 542.

The width of the open region 60A at the region in which the protrusions 66 are disposed is slightly smaller than the diameter R11 of the shaft portion 55 in the device-side member 5. Hence, when the shaft portion 55 moves upward along the open region 60A, the shaft portion 55 contacts the protrusions 66 from below. The protrusions 66 restrict further upward movement of the shaft portion 55.

As the operator applies more force to the device-side member 5 in the upward direction, forces are applied to the protrusions 66 in outwardly directions as the shaft portion 55 moves upward. In response to the forces applied by the shaft portion 55 to the protrusions 66, the first curved portion 63 resiliently deforms so as to expand the gap between the protrusions 66A and 66B. The gap between the base portion 60 and first segment portion 61 expands until the shaft portion 55 can pass therethrough. Consequently, the shaft portion 55 moves from below to above the protrusions 66. As shown in FIG. 11, the shaft portion 55 moves to the bearing portion 63A of the attaching-side member 6. When the shaft portion 55 has moved into the bearing portion 63A, the protrusions 66 no longer receive force from the shaft portion 55. Thus, the resiliently deformed first curved portion 63 returns to its original shape, thereby engaging the shaft portion 55 in the bearing portion 63A. Since the width of the open region 60A in the region at which the protrusions 66 are disposed is slightly smaller than the diameter R11 of the shaft portion 55, the shaft portion 55 is retained in the bearing portion 63A. In other words, the shaft portion 55 is restricted from moving downward past the protrusions 66.

The shaft portion 55 is oriented in the left-right direction when retained in the bearing portion 63A. As described above, the radius of the shaft portion 55 (R11/2) is approximately equal to the radius of curvature of the bearing portion 63A. Hence, the bearing portion 63A can rotatably support the shaft portion 55. Hereinafter, a state in which the shaft portion 55 is rotatably supported in the bearing portion 63A and prior to the engaging portion 57 being engaged with the engaged part 64A (i.e., a state of the attaching loop member 3 shown in FIG. 11) will be called a "first engaged state."

In the first engaged state, the user then pivotally moves device-side member 5 about the shaft portion 55 relative to the attaching-side member 6. Specifically, the device-side member 5 is pivoted in a direction that moves the engaging portion 57 toward the attaching-side member 6 (hereinafter called an "engaging direction", indicated by an arrow Y3 in FIG. 12). As the device-side member 5 is pivoted, the distal end of the engaging portion 57 is brought into contact with the engaged part 64A of the attaching-side member 6. The user continues to apply force to the device-side member 5 for pivoting the device-side member 5 in the engaging direction Y3. Consequently, the engaged part 64A applies a force to the engaging portion 57 for increasing the radius of curvature of the engaging portion 57. As described above, the engaging portion 57 is resiliently deformable and thus has flexibility. Therefore, the engaging portion 57 resiliently deforms, increasing its radius of curvature to be larger than the R12. The device-side member 5 is pivoted until the rear surface of the device-side plate portion 51 contacts the front surfaces of the first segment portion 61 and second segment portion 62 constituting the attaching-side member 6. At this time, the inner surface of the engaging portion 57 is in contact with the engaged part 64A.

Figure 13:
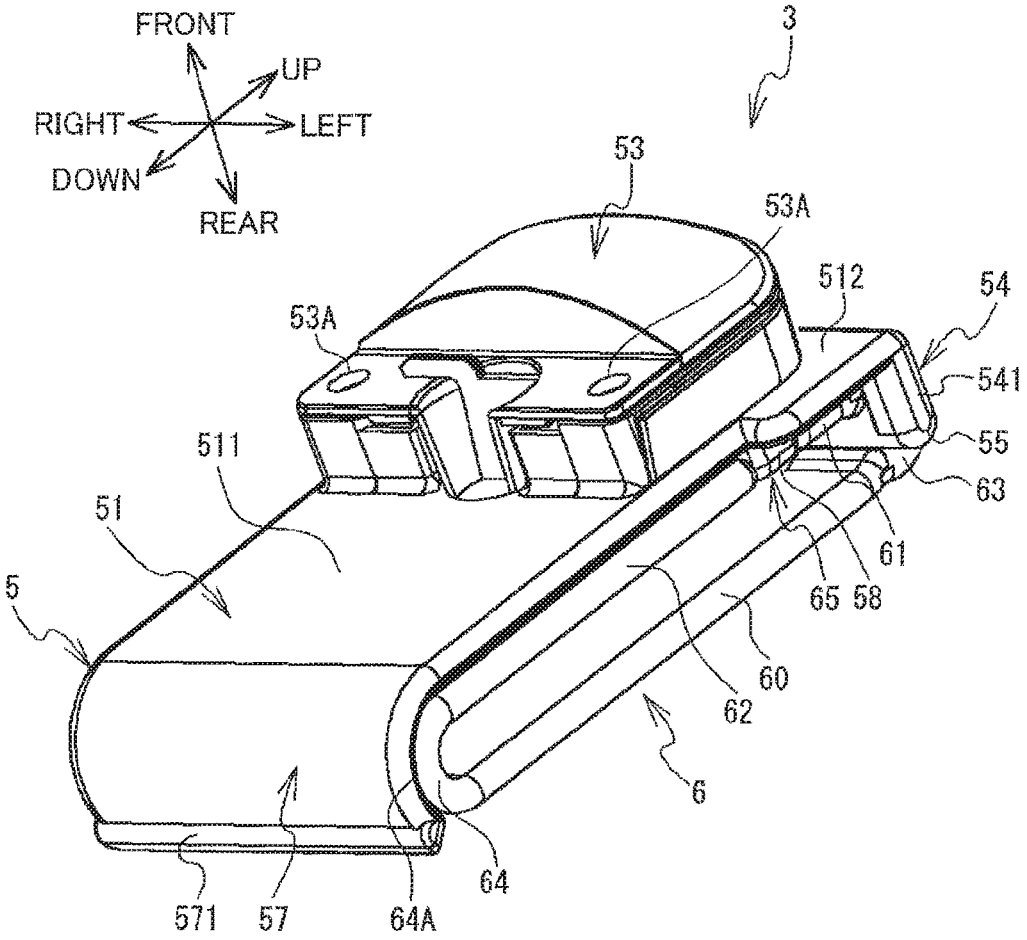
FIG. 13 is a perspective view of the attaching loop member according to the embodiment in the second engaged state as viewed from downward and frontward.
Figure 14:
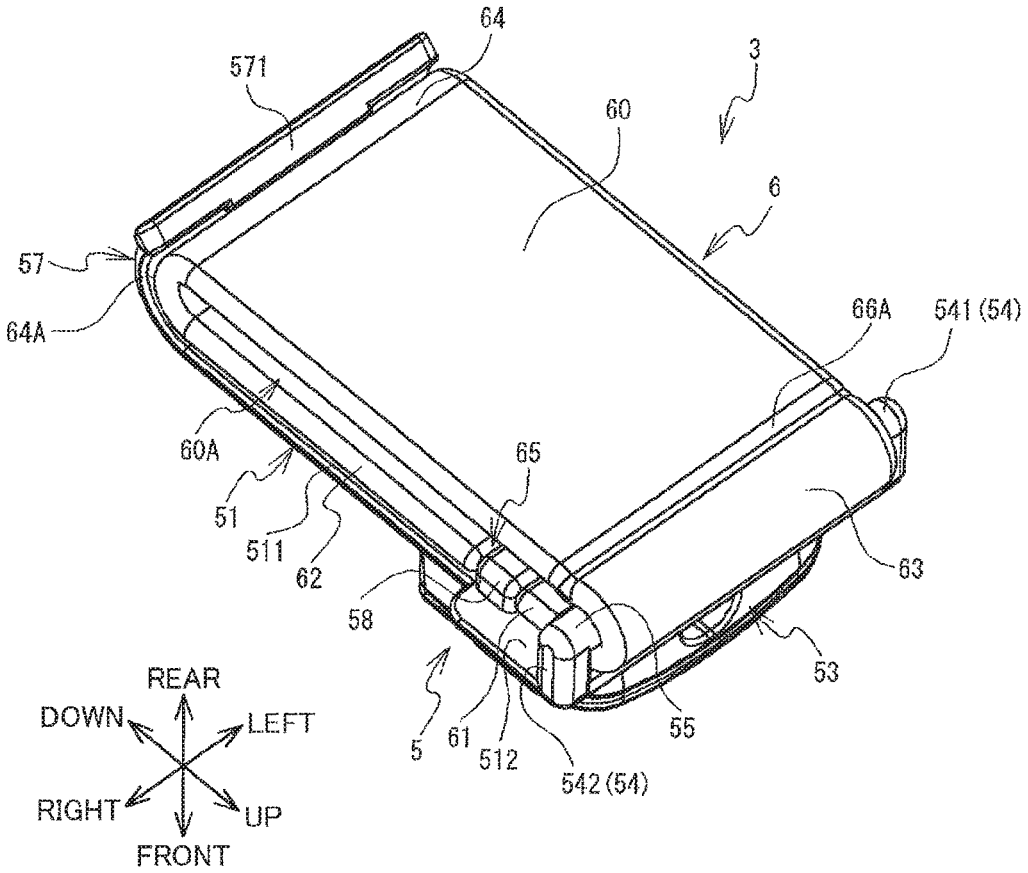
FIG. 14 a perspective view of the attaching loop member according to the embodiment in the second engaged state as viewed from rearward and rightward.

After the inner surface of the engaging portion 57 contacts the engaged part 64A, the resiliently deformed engaging portion 57 returns to its original state, and the radius of curvature of the engaging portion 57 returns to the original R12. Note that the radius of curvature R12 of the engaged part 64A is approximately equal to the radius of curvature of the engaging portion 57. Therefore, the engaging portion 57 contacts and engages the engaged part 64A from outward thereof, as illustrated in FIGS. 12 through 14. The inner surface of the engaging portion 57 is in close contact with the engaged part 64A (i.e., the outer surface of the second curved portion 64). Hereinafter, a state in which the engaging portion 57 is engaged with the engaged part 64A (i.e., a state of the attaching loop member 3 shown in FIGS. 12 to 14) will be called a "second engaged state".

During the process of shifting the attaching loop member 3 from the first engaged state to the second engaged state, the rib 58 of the device-side member 5 is fitted into the slit 65 of the attaching-side member 6. Since the width of the slit 65 is L23, which is substantially equivalent to the vertical dimension of the rib 58 (see FIGS. 5 and 7), the rib 58 closes the slit 65. Hence, if the belt 1B were to move upward along the open region 60A of the attaching-side member 6, as illustrated in FIG. 12, for example, the rib 58 suppresses the belt 1B from coming out of the open region 60A through the slit 65.

When the attaching loop member 3 is in the second engaged state, the printing device 2 is retained on the belt 1B. Any downward force applied to the printing device 2 and device-side member 5 (for example, the weight of the printing device 2 and device-side member 5 themselves) is applied to the bearing portion 63A supporting the shaft portion 55 and the slit 65 supporting the rib 58 from below. As described above, the slit 65 is formed by the bottom edge of the first segment portion 61 and top edge of the second segment portion 62. Therefore, the rib 58 is supported from below by the top edge of the second segment portion 62. However, for simplifying description, the following description assumes that the rib 58 is supported by the slit 65. Hence, the printing device 2 and device-side member 5 are retained on the belt 1B while being supported by the bearing portion 63A and slit 65 of the attaching-side member 6.

Since the engaging portion 57 is engaged with the engaged part 64A in the second engaged state, as shown in FIGS. 13 and 14, this engagement restricts movement of the device-side member 5 in a direction opposite the engaging direction Y3 (hereinafter called a "separating direction", indicated by an arrow Y4 in FIG. 12). That is, the engagement between the engaging portion 57 and engaged part 64A restricts the device-side member 5 from pivotally moving in the separating direction Y4 in which the engaging portion 57 moves away from the engaged part 64A. Accordingly, the attaching loop member 3 is firmly held in the second engaged state and is restricted from returning to the first engaged state. Therefore, the printing device 2 fixed to the device-side member 5 can be firmly held on the belt 1B through the attaching-side member 6.

Next, an example will be given in which the printing device 2 and attaching loop member 3 are moved downward relative to the belt 1B by a downward force. Here, the open region 60A and bearing portion 63A are arranged to be aligned with each other in the vertical direction. Accordingly, the belt 1B moves smoothly upward relative to the attaching loop member 3. Through this relative movement, a top edge of the belt 1B comes into contact with the shaft portion 55 supported in the bearing portion 63A from below, as illustrated in FIG. 12. In this state, the belt 1B restricts downward movement of the shaft portion 55, thereby suppressing the shaft portion 55 from coming out of the bearing portion 63A.

Next, how to separate the printing device 2 from the belt 1B will be described. To do this, the user first applies force to the protruding part 571 to flex the engaging portion 57 outward until the radius of curvature of the engaging portion 57 is greater than the R12. The engaging portion 57 therefore resiliently deforms so that its radius of curvature becomes larger than the R12. Next, the user pivots the device-side member 5 in the separating direction, thereby separating the engaging portion 57 from the engaged part 64A. Subsequently, the user releases the force applied to the engaging portion 57, allowing the resiliently deformed engaging portion 57 to return to its original state. Through this operation, the attaching loop member 3 is shifted from the second engaged state (see FIGS. 12 through 14) to its first engaged state (see FIG. 11).

Next, the user moves the device-side member 5 downward relative to the attaching-side member 6. The first curved portion 63 resiliently deforms, allowing the shaft portion 55 to pass between the protrusions 66A and 66B. The shaft portion 55 moves along the open region 60A to the slit 65 (see FIG. 10). Next, the user pulls the device-side member 5 forward so that the shaft portion 55 moves out of the open region 60A through the slit 65. Through this operation, the attaching loop member 3 changes from the first engaged state to the separated state, thereby separating the printing device 2 from the belt 1B.

<Operational and Technical Advantages>

As described above, the user can attach the printing device 2 to the belt 1B through the attaching loop member 3 by moving the attaching loop member 3 from the separated state to the second engaged state via the first engaged state. Further, the user can separate the printing device 2 from the belt 1B by moving the attaching loop member 3 in the second engaged state to the separated state through the first engaged state. In this way, the device-side member 5 and attaching-side member 6 of the attaching loop member 3 can be mounted and removed through a simple procedure. Hence, the user can easily perform an operation for attaching the printing device 2 to the belt 1B.

The structure of the attaching loop member 3 that allows mounting and removal of the device-side member 5 is achieved by configuring the attaching-side member 6 only to have a simple structure configured of the attaching-side plate portion 6A (base portion 60, first segment portion 61, second segment portion 62, first curved portion 63, and second curved portion 64), the bearing portion 63A, the engaged part 64A, and the open region 60A. Further, since the open region 60A and bearing portion 63A are aligned in the vertical direction, the structure of the attaching-side member 6 can be simplified. This configuration can prevent other objects from catching on part of the attaching-side member 6 when the user performs an operation after removing the printing device 2 and device-side member 5 from the attaching-side member 6 while leaving only the attaching-side member 6 attached to the belt 1B, for example.

When the attaching loop member 3 is shifted from the first engaged state to the second engaged state, the engaging portion 57 resiliently deforms to engage the engaged part 64A. Further, the radius of curvature of the engaging portion 57 constituting the device-side member 5 is substantially equal to the radius of curvature of the engaged part 64A constituting the attaching-side member 6. Accordingly, the inner surface of the engaging portion 57 can closely contact the engaged part 64A when the engaging portion 57 becomes engaged with the engaged part 64A. Thus, the structure of the attaching loop member 3 enables the engaging portion 57 to be firmly engaged with the engaged part 64A.

The slit 65 is formed between the bottom edge of the first segment portion 61 and the top edge of the second segment portion 62. The width L23 of the slit 65 is substantially equal to the vertical dimension of the rib 58 constituting the device-side member 5. The width L23 of the slit 65 is slightly larger than the diameter R11 of the shaft portion 55. Hence, when the attaching loop member 3 is shifted from its separated state to its first engaged state, the shaft portion 55 can be inserted into the open region 60A through the slit 65. Further, the width L32 of the open region 60A constituting the attaching-side plate portion 6A is slightly larger than the diameter R11 of the shaft portion 55 constituting the device-side member 5. Hence, when the attaching loop member 3 is shifted from the separated state to the first engaged state, the shaft portion 55 can move along the open region 60A to pass a region between the base portion 60 and first segment portion 61 in order to reach the bearing portion 63A.

The gap L31 between the second section 512 of the device-side plate portion 51 and the shaft portion 55 is slightly larger than the thickness L33 of the first segment portion 61 constituting the attaching-side member 6. Further, the distance between the inner surfaces (right and left surfaces) of the shaft support parts 541 and 542 that support the shaft portion 55 is slightly greater than the left-right dimension L11 of the attaching-side plate portion 6A constituting the attaching-side member 6. Hence, when the attaching loop member 3 is shifted from the separated state to the first engaged state, the first segment portion 61 can pass between the second section 512 of the device-side plate portion 51 and the shaft portion 55 and between the shaft support parts 541 and 542 as the shaft portion 55 moves upward through the open region 60A of the attaching-side member 6.

The rib 58 is disposed on the rear surface of the device-side plate portion 51. The rib 58 is fitted into the slit 65 of the attaching-side member 6 when the attaching loop member 3 is shifted from the first engaged state to the second engaged state. Consequently, when the attaching loop member 3 is in the second engaged state, the printing device 2 and device-side member 5 are supported not only by the bearing portion 63A receiving the shaft portion 55, but also by the slit 65 fitted around the rib 58. Accordingly, the slit 65 can reduce downward load that the bearing portion 63A receives through the shaft portion 55. Hence, the attaching loop member 3 can restrain the shaft portion 55 from coming out of the bearing portion 63A by a downward load applied to the printing device 2 and device-side member 5.

The protrusions 66 are provided on the top edges of the base portion 60 and first segment portion 61. The width of the open region 60A in the attaching-side plate portion 6A in the region that the protrusions 66 are disposed is slightly smaller than the diameter R11 of the shaft portion 55. When the attaching loop member 3 shifts from the separated state to the first engaged state, the first curved portion 63 resiliently deforms so as to widen the gap between the protrusions 66A and 66B. After the shaft portion 55 passes from the bottom side of the protrusions 66 to the top side thereof, the resiliently deformed first curved portion 63 returns to its original state. In this state, the bearing portion 63A retains the shaft portion 55, and the protrusions 66 restrain the shaft portion 55 from moving downward. Thus, the protrusions 66 can suppress the shaft portion 55 from coming out of the bearing portion 63A while the attaching loop member 3 is in the first engaged state. Further, the resilient deformation of the first curved portion 63 enables the shaft portion 55 to be reliably engaged in the bearing portion 63A.

The vertical dimension L21 of the second segment portion 62 is greater than the vertical dimension L24 of the first segment portion 61, as shown in FIG. 6. In other words, the dimensions of the second segment portion 62 and first segment portion 61 can be adjusted in the attaching loop member 3 so that the vertical dimension L21 of the second segment portion 62 is larger than other portions. This arrangement enables the belt 1B inserted through the open region 60A to be more easily positioned near the second segment portion 62 in the vertical direction such that the top edge of the belt 1B is located below the slit 65. Therefore, the shaft portion 55 can pass through the slit 65 while the belt 1B is inserted in the open region 60A. Accordingly, the printing device 2 fixed to the device-side member 5 can be attached to and detached from the attaching-side member 6 when the attaching-side member 6 is mounted on the belt 1B.

In the attaching loop member 3 of the embodiment, the space provided by the bearing portion 63A of the attaching-side member 6 is in communication with the open region 60A to form a continuous space in the attaching-side plate part 6A. Hence, if the belt 1B moves upward relative to the attaching loop member 3 due to a downward force applied to the printing device 2 and attaching loop member 3, the top edge of the belt 1B will contact the bottom of the shaft portion 55 supported by the bearing portion 63A of the attaching-side member 6, thereby restricting the shaft portion 55 from moving downward. Hence, the belt 1B can restrict the shaft portion 55 from coming out of the bearing portion 63A.

2. Modification to the Embodiment

Next, an attaching loop member 3M according a modification to the embodiment will be described with reference to FIGS. 15 through 18.

The attaching loop member 3M according to the modification includes the device-side member 5, and an attaching-side member 7 instead of attaching-side member 6.

The attaching-side member 7 of the modification differs from the attaching-side member 6 of the embodiment in that the attaching-side member 7 is provided with a first curved portion 73 and protrusions 76 in place of the first curved portion 63 and protrusions 66. The remaining structure of the attaching-side member 7 is identical to the attaching-side member 6 described above. The following description focuses on the differences from the attaching-side member 6 rather than the similar parts.

Figure 15:
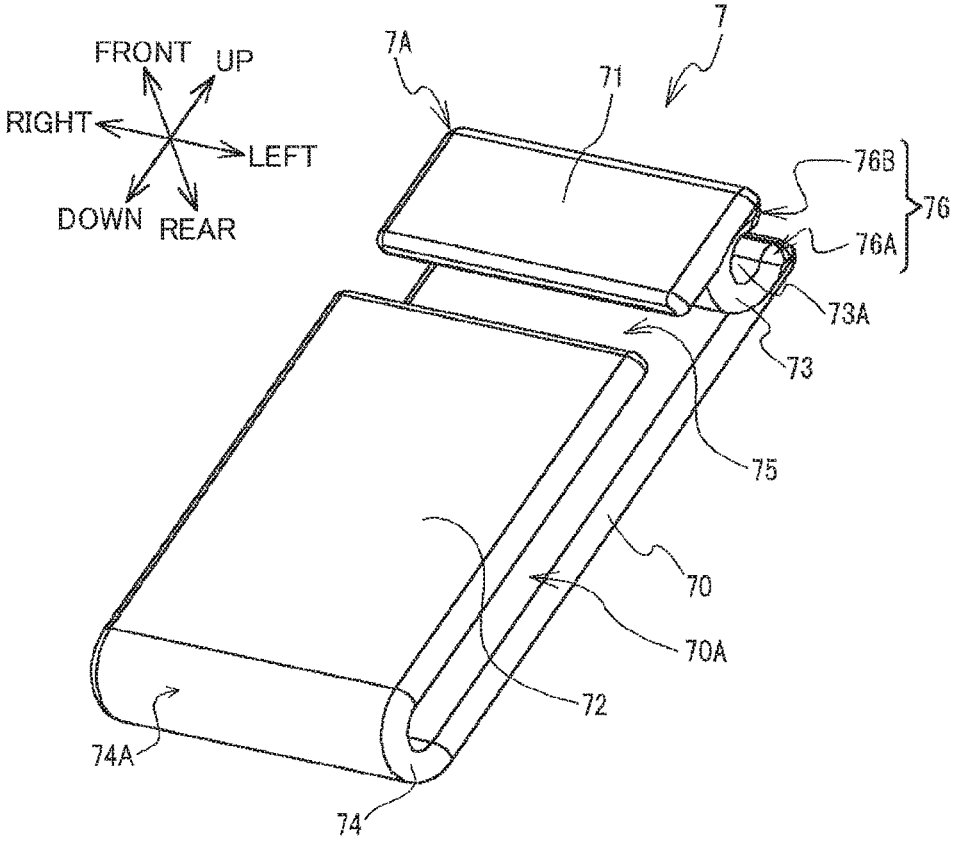
FIG. 15 is a perspective view of an attaching-side member according to a modification to the embodiment.

More specifically, referring to FIG. 15, the attaching-side member 7 has an attaching-side plate portion 7A. The attaching-side plate portion 7A includes a base portion 70, a first segment portion 71, a second segment portion 72, a slit 75, and a second curved portion 74 (engaged part 74A) which correspond to the base portion 60, first segment portion 61, second segment portion 62, slit 65 and second curved portion 64 (engaged part 64A) of the depicted embodiment, respectively. The attaching-side plate portion 7A further includes the first curved portion 73 and the protrusions 76. An open region 70A is defined in the attaching-side plate portion 7A, instead of the open region 60A.

Figure 16:
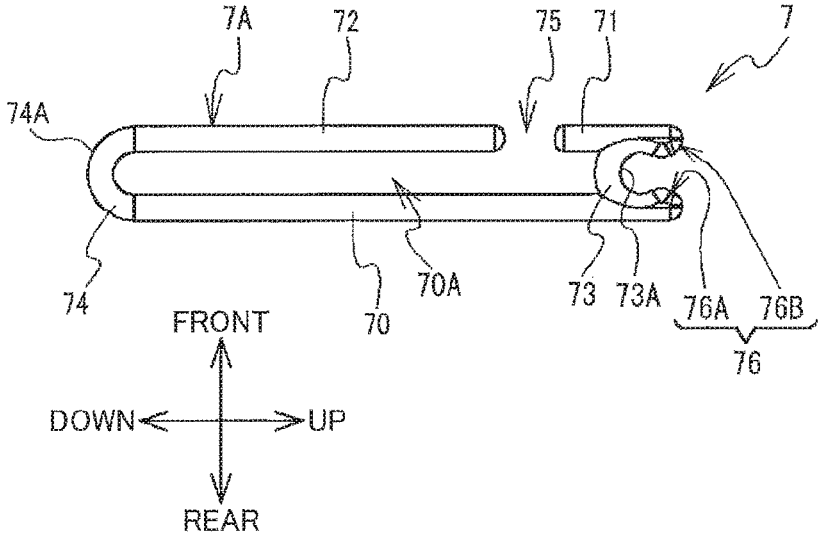
FIG. 16 is a left side view of the attaching-side member according to the modification to the embodiment.

As shown in FIGS. 15 and 16, the first curved portion 73 is connected to the top edges of the base portion 70 and first segment portion 71. The first curved portion 73 is curved in a general U-shape in a side view. The first curved portion 73 is disposed lower than the top edges of the base portion 70 and first segment portion 71. In this way, a bearing portion 73A corresponding to an inner surface of the first curved portion 73 is arranged lower than the top edges of the base portion 70 and first segment portion 71. The bearing portion 73A is open on the top. That is, unlike the attaching-side member 6 of the embodiment, the open region 70A is not in communication with the space provided by the bearing portion 73A. Rather, the bearing portion 73A (first curved part 73) partitions the space provided by the bearing portion 73A and the open region 70A in the vertical direction, i.e., interrupts communication between the space provided by the bearing portion 73A and the open region 70A, when the attaching-side member 7 is attached to the device-side member 5.

As shown in FIG. 16, the protrusions 76 are configured of a protrusion 76A and a protrusion 76B. The protrusion 76A is disposed on the top edge of the base portion 70, and the protrusion 76B is disposed on the top edge of the first segment portion 71. The protrusion 76A protrudes forward, while the protrusion 76B protrudes rearward. The protrusions 76A and 76B oppose each other in the front-rear direction. In the following description, the protrusions 76A and 76B will be collectively called the "protrusions 76." The protrusions 76 are in proximity to the top of the bearing portion 73A. A gap between the protrusions 76A and 76B is slightly smaller than the diameter R11 of the shaft portion 55 constituting the device-side member 5 (see FIG. 5).

Next, how to use the attaching loop member 3M according to the modification will be described. First, the device-side member 5 and attaching-side member 7 are separate from each other to bring the attaching loop member 3M into its separated state. The belt 1B is then inserted into the open region 70A of the attaching-side plate portion 7A and mounted on the attaching-side member 7. The user then positions the device-side member 5 above the attaching-side member 7 mounted on the belt 1B and adjusts the device-side member 5 so that the device-side plate portion 51 is sloped relative to the front-rear direction. The user then arranges the device-side member 5 so that the shaft portion 55 is located above the bearing portion 73A of the attaching-side member 7.

Next, the user moves the device-side member 5 downward toward the attaching-side member 7 until the shaft portion 55 contacts the protrusions 76 of the attaching-side member 7 from above. The protrusions 76 restrict downward movement of the shaft portion 55, but the user can move the device-side member 5 farther downward by applying more downward force. As the shaft portion 55 moves downward, the shaft portion 55 applies outward force to the protrusions 76. Consequently, the first curved portion 73 resiliently deforms so that the gap between the protrusions 76A and 76B increases. In this way, the gap between the base portion 70 and first segment portion 71 increases to allow passage of the shaft portion 55. Accordingly, the shaft portion 55 passes from above to below the protrusions 76 to reach the bearing portion 73A. At this time, the resiliently deformed first curved portion 73 returns to its original state, engaging the shaft portion 55 with the bearing portion 73A. The bearing portion 73A rotatably supports the shaft portion 55 while the attaching loop member 3M is in the first engaged state.

Figure 17:
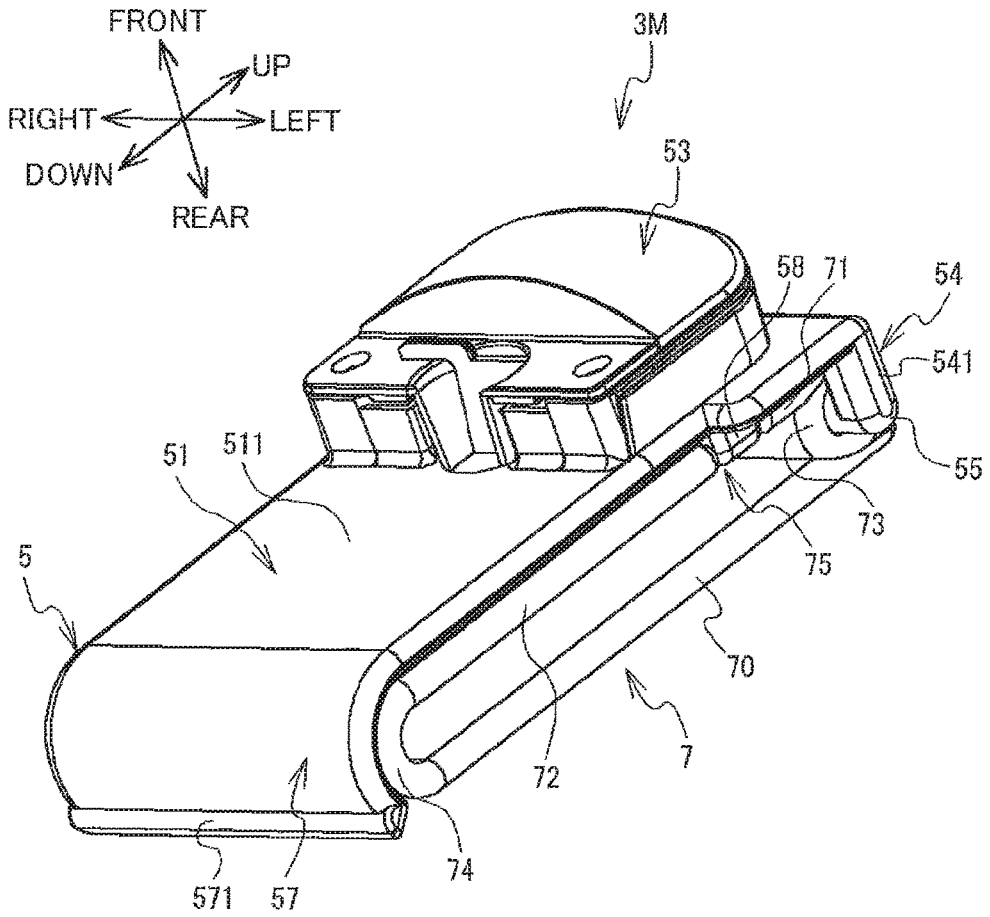
FIG. 17 is a perspective view of an attaching loop member according to the modification to the embodiment in its second engaged state.
Figure 18:
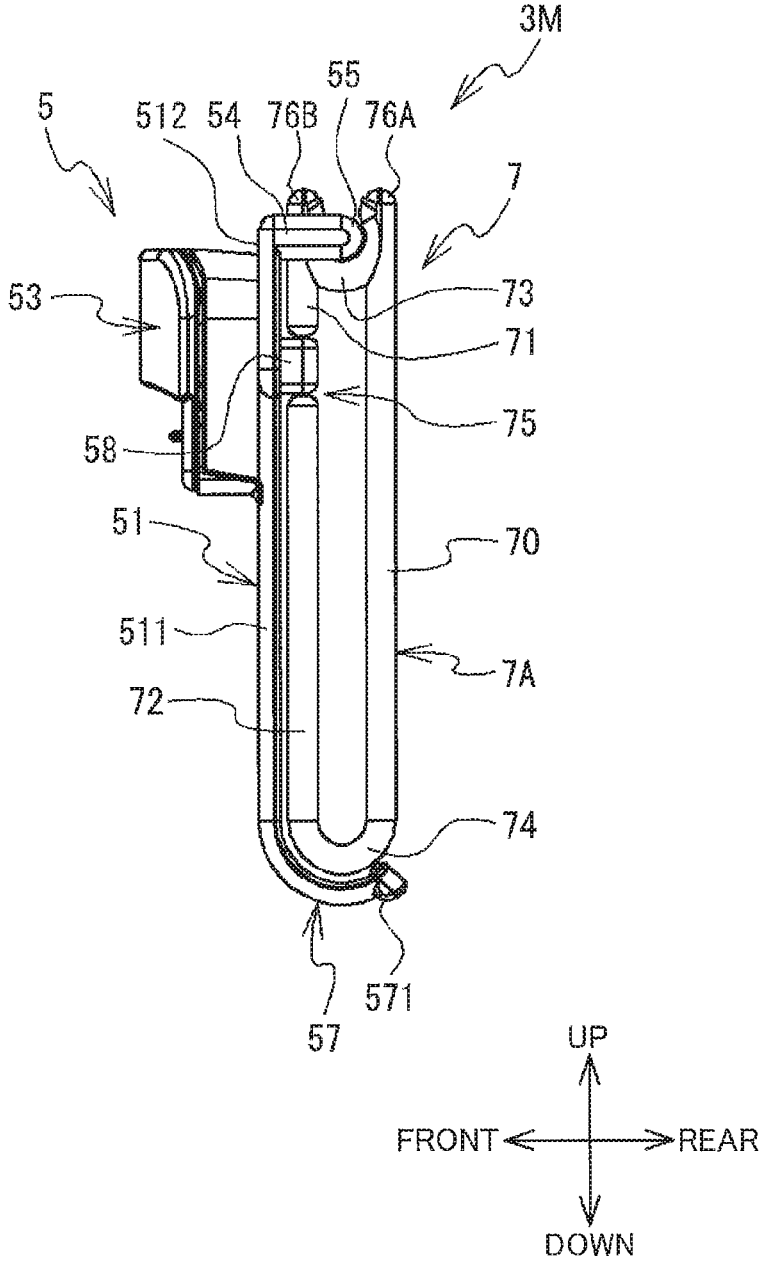
FIG. 18 is a left side view of the attaching loop member according to the modification to the embodiment in its second engaged state.

In the first engaged state, the device-side member 5 can pivot about the shaft portion 55 in an engaging direction (substantially parallel to the engaging direction Y3) relative to the attaching-side member 7. As shown in FIGS. 17 and 18, the user engages the engaging portion 57 with the engaged part 74A, placing the attaching loop member 3M in the second engaged state. In the process of shifting the attaching loop member 3M from the first engaged state to the second engaged state, the rib 58 of the device-side member 5 becomes fitted into the slit 75 of the attaching-side member 7. In this state, the rib 58 closes the slit 75. When in the second engaged state, the attaching loop member 3M retains the printing device 2 on the belt 1B.

In this modification, the printing device 2 and device-side member 5 are supported by the first curved portion 73 that receives the shaft portion 55 from below and the slit 75 in which the rib 58 is fitted when a downward load is applied to the printing device 2 and device-side member 5. In this way, the attaching-side member 7 can reliably retain the printing device 2 fixed to the device-side member 5 on the belt 1B.

3. Other Variations of the Embodiment

In the depicted embodiment, the belt 1B is inserted through the open region 60A of the attaching-side member 6 constituting the attaching loop member 3. However, the attaching loop member 3 may be attached to an object other than a belt worn about the user's waist, such as a shoulder strap or the like hung over the user's shoulder.

Further, the attaching-side member 6 may be configured with the top edge of the second segment portion 62 bent rearward. In this case, the rearwardly bent top edge of the second segment portion 62 may be joined to the front surface of the base portion 60. In other words, a closed loop may be formed with just the base portion 60 and second segment portion 62. In this case, the open region 60A may be formed in a region between the base portion 60 and second segment portion 62. Further, the radii of curvature for the engaging portion 57 and engaged part 64A may be different from each other. In this case, a groove may be formed in the engaged part 64A, and a protrusion may be formed on part of the distal edge of the engaging portion 57 for being fitted into the groove. Here, the engaging portion 57 need not have flexibility.

Further, the width L23 of the slit 65 formed in the attaching-side member 6 may be substantially equivalent to the diameter R11 of the shaft portion 55 constituting the device-side member 5, or may be smaller than the diameter R11. For example, the first curved portion 63 and second curved portion 64 of the attaching-side member 6 may be resiliently deformed so as to increase the width of the slit 65 to a length greater than the diameter R11 of the shaft portion 55, thereby allowing the shaft portion 55 to pass through the slit 65.

The gap L32 between the first segment portion 61 and base portion 60 may be substantially equivalent to the diameter R11 of the shaft portion 55 or may be smaller than the diameter R11. For example, the first curved portion 63 may be resiliently deformed to expand the gap between the first segment portion 61 and base portion 60 to a distance greater than the diameter R11 of the shaft portion 55. In this way, the shaft portion 55 can pass through the region of the open region 60A between the base portion 60 and first segment portion 61.

Further, the gap between the shaft support parts 541 and 542 may be smaller than the left-right dimension L11 of the slit 65 formed in the attaching-side member 6. In this case, grooves extending upward from the slit 65 may be formed in the first segment portion 61 of the attaching-side member 6, for example. When the attaching loop member 3 is shifted from the separated state into the first engaged state, the shaft support parts 541 and 542 may move upward through these grooves as the shaft portion 55 moves upward along the open region 60A.

The vertical dimension of the rib 58 may be smaller than the width of the slit 65. Alternatively, the rib 58 may be omitted from the device-side member 5.

The protrusions 66 in the embodiment are formed by bending portions of the attaching-side plate portion 6A into the open region 60A. However, the protrusions 66 may be formed by disposing protruding parts on the inner surfaces of the attaching-side plate portion 6A. Alternatively, just one of the protrusion 66A and 66B may be formed on the attaching-side plate portion 6A, or both protrusions 66 may be omitted from the attaching-side plate portion 6A.

The vertical dimensions of the first segment portion 61 and second segment portion 62 may be set substantially equal to each other. Further, the vertical dimension of the first segment portion 61 may be greater than the vertical dimension of the second segment portion 62. The vertical dimension of the second segment portion 62 may be smaller than the width of an average belt 1B. In this case, the belt 1B may be inserted into the open region 60A through the slit 65.

The device-side member 5 may be formed integrally with the printing device 2. In other words, the device-side plate portion 51, fixing portion 53, shaft support part 54, shaft portion 55, engaging portion 57, and rib 58 of the device-side member 5 may be formed as parts of the second casing 20B constituting the printing device 2.

While the disclosure is described in detail with reference to the specific embodiments thereof while referring to accompanying drawings, it would be apparent to those skilled in the art that many modifications and variations may be made therein without departing from the scope of the disclosure.

What is claimed is:

1. An attaching loop member configured to mount a printing device on a belt-like member worn by a user, the attaching loop member comprising:

a device-side member connectable to the printing device, the device-side member comprising:

a device-side plate portion having a flat plate-like shape, the device-side plate portion having one end and another end opposite to each other;

a fixing portion provided on the device-side plate portion and configured to be fixed to the printing device;

a shaft portion provided at the one end of the device-side plate portion; and an engaging portion provided at the another end of the device-side plate portion; and an attaching-side member mountable on the belt-like member worn by the user, the device-side member being attachable to and detachable from the attaching-side member, the attaching-side member comprising:

a bearing portion configured to be engaged with and disengaged from the shaft portion, engagement of the shaft portion with the bearing portion allowing the device-side member to pivot relative to the attaching-side member in a first pivot direction and in a second pivot direction opposite the first pivot direction, the another end of the device-side plate portion moving toward the attaching-side member in the first pivot direction, the another end of the device-side plate portion moving away from the attaching-side member in the second pivot direction;

an engaged portion configured to be engaged with and disengaged from the engaging portion, pivoting of the device-side member with the shaft portion engaged with the bearing portion in the first pivot direction bringing the engaging portion into engagement with the engaged portion, pivoting of the device-side member with the shaft portion engaged with the bearing portion in the second pivot direction causing the engaging portion to be disengaged from the engaged portion; and a retaining portion configured to retain the belt-like member, the retaining portion providing an open region between the bearing portion and the engaged portion, the retaining portion extending in a first direction to provide the open region extending in the first direction, the open region allowing the belt-like member to penetrate through the open region in the first direction.

2. The attaching loop member according to claim 1, wherein the attaching-side member comprises an attaching-side plate portion elongated in a second direction perpendicular to the first direction, the attaching-side plate portion comprising:

a base portion having a flat plate shape elongated in the second direction, the base portion having one base end and another base end opposite the one base end in the second direction;

a first segment portion having a flat plate shape, the first segment portion having one first-segment end and another first-segment end opposite the one first-segment end in the second direction;

a second segment portion having a flat plate shape and aligned with the first segment portion in the second direction, the second segment portion having one second-segment end and another second-segment end opposite the one second-segment end in the second direction, the first segment portion and the second segment portion opposing the base portion to define a prescribed gap therebetween in a third direction perpendicular to the first direction and the second direction, the base portion and the first segment portion and the second segment portion constituting the retaining portion, the prescribed gap serving as the open region;

a first curved portion connecting the one base end of the base portion and the one first-segment end of the first segment portion, the first curved portion having a generally U shape in a side view and having a curved inner surface serving as the bearing portion; and a second curved portion connecting the another base end of the base portion and the another second-segment end of the second segment portion, the second curved portion having a generally U shape in a side view and having a curved outer surface serving as the engaged portion, wherein the engaging portion of the device-side member is curved to have a radius of curvature substantially identical to a radius of curvature for the engaged portion of the attaching-side member, the engaging portion being resiliently deformable, and wherein the pivoting of the device-side member in the first pivot direction relative to the attaching-side member with the shaft portion engaged with the bearing portion causing the engaging portion to resiliently deform to be engaged with the engaged portion.

3. The attaching loop member according to claim 2, wherein the another first-segment end of the first segment portion and the one second-segment end of the second segment portion define a gap therebetween in the second direction, the gap serving as a slit and extending in the first direction, wherein the device-side member further comprises a pair of shaft-support portions protruding from a first surface of the device-side plate portion, wherein the shaft portion has a length larger than a length of the attaching-side member in the first direction, the shaft portion having both ends in the first direction respectively supported by the shaft-support portions, the shaft portion extending parallel to the device-side plate portion and being spaced apart from the device-side plate portion by a distance larger than a thickness of the first segment portion of the attaching-side member, and wherein the shaft portion in engagement with the bearing portion extends in the first direction, the slit allowing passage of the shaft portion, the prescribed gap between the base portion and the first segment portion allowing the passage of the shaft portion.

4. The attaching loop member according to claim 3, wherein the device-side member further comprises a rib protruding from the first surface of the device-side plate portion, the rib extending in the first direction and being fitted in the slit when the device-side member is attached to the attaching-side member.

5. The attaching loop member according to claim 4, wherein the device-side plate portion has a second surface opposite the first surface, the fixing portion being provided on the second surface of the device-side plate portion.

6. The attaching loop member according to claim 2, wherein the attaching-side member further comprises at least one protrusion provided near the bearing portion of the first curved portion, the at least one protrusion being provided on at least one of the base portion and the first segment portion, and wherein the first curved portion is resiliently deformable to enlarge the prescribed gap between the base portion and the first segment portion, the least one protrusion allowing passage of the shaft portion through the prescribed gap upon resilient deformation of the first curved portion, the least one protrusion restricting passage of the shaft portion through the prescribed gap without resilient deformation of the first curved portion.

7. The attaching loop member according to claim 2, wherein the first segment portion has a length in the second direction smaller than a length of the second segment portion in the second direction.

8. The attaching loop member according to claim 1, wherein the bearing portion provides a space for receiving the shaft portion therein, the space being in communication with the open region.

9. The attaching loop member according to claim 1, wherein the bearing portion provides a space for receiving the shaft portion therein, the bearing portion interrupting communication between the space provided by the bearing portion and the open region in a second direction perpendicular to the first direction when the device-side member is attached to the attaching-side member.

10. A printing device mountable on a belt-like member worn by a user, the printing device comprising:

a housing configured to accommodate print medium therein;

a device-side member connectable to the housing and comprising:

a device-side plate portion having a flat plate-like shape, the device-side plate portion having one end and another end opposite to each other;

a fixing portion provided on the device-side plate portion and configured to be fixed to the housing;

a shaft portion provided at the one end of the device-side plate portion; and an engaging portion provided at the another end of the device-side plate portion; and an attaching-side member mountable on the belt-like member worn by the user, the device-side member being attachable to and detachable from the attaching-side member, the attaching-side member comprising:

a bearing portion configured to be engaged with and disengaged from the shaft portion, engagement of the shaft portion with the bearing portion allowing the device-side member to pivot relative to the attaching-side member in a first pivot direction and in a second pivot direction opposite the first pivot direction, the another end of the device-side plate portion moving toward the attaching-side member in the first pivot direction, the another end of the device-side plate portion moving away from the attaching-side member in the second pivot direction;

an engaged portion configured to be engaged with and disengaged from the engaging portion, pivoting of the device-side member with the shaft portion engaged with the bearing portion in the first pivot direction bringing the engaging portion into engagement with the engaged portion, pivoting of the device-side member with the shaft portion engaged with the bearing portion in the second pivot direction causing the engaging portion to be disengaged from the engaged portion; and a retaining portion configured to retain the belt-like member, the retaining portion providing an open region between the bearing portion and the engaged portion, the retaining portion extending in a first direction to provide the open region extending in the first direction, the open region allowing the belt-like member to penetrate the open region in the first direction.

* * * * *